US008021024B2

(12) United States Patent
Huang

(10) Patent No.: US 8,021,024 B2
(45) Date of Patent: Sep. 20, 2011

(54) LED LAMP

(75) Inventor: Xing-Gui Huang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 290 days.

(21) Appl. No.: 12/533,001

(22) Filed: Jul. 31, 2009

(65) Prior Publication Data

US 2010/0296287 A1 Nov. 25, 2010

(30) Foreign Application Priority Data

May 19, 2009 (CN) ..... 200910302450

(51) Int. Cl.
*F21V 29/00* (2006.01)
*F21S 4/00* (2006.01)

(52) U.S. Cl. ..... 362/294; 362/249.02; 362/373; 362/371; 362/267

(58) Field of Classification Search ..... 362/249.02, 362/294, 373, 371, 267
See application file for complete search history.

(56) References Cited

U.S. PATENT DOCUMENTS

| | | | | |
|---|---|---|---|---|
| 7,766,514 | B2 * | 8/2010 | Chen | 362/294 |
| 7,810,958 | B2 * | 10/2010 | Liu et al. | 362/294 |
| 2009/0323361 | A1 * | 12/2009 | Liu | 362/373 |
| 2010/0265709 | A1 * | 10/2010 | Liu | 362/249.02 |

* cited by examiner

*Primary Examiner* — Stephen F Husar
*Assistant Examiner* — James Cranson, Jr.
(74) *Attorney, Agent, or Firm* — Altis Law Group, Inc.

(57) ABSTRACT

An LED lamp includes a monolithic housing made of metal extrusion and comprising a heat sink and a receiving portion integrally extending from a bottom of the heat sink, a plurality of LED modules attached to the heat sink, a cover covering the LED modules and a supporting bracket mounted on the housing. The heat sink includes a planar base and a plurality of fins extending from a top face of the base. The receiving portion includes a frame defining a window at a center thereof and two sidewalls interconnecting the frame and the base. The frame, the sidewalls and the base cooperatively define a receiving chamber for accommodating the LED modules therein. The LED modules are attached to the base and located corresponding to the window of the frame. The cover is mounted on a bottom of the frame and correspondingly covers the window.

17 Claims, 3 Drawing Sheets

LED LAMP

BACKGROUND

1. Technical Field

The disclosure relates to light emitting diode (LED) lamps and, particularly, to an LED lamp having an improved heat dissipation structure.

2. Description of Related Art

As highly effective light sources, LED lamps are widely used in various fields. An LED lamp includes a number of LEDs, and most of the LEDs are driven at the same time, which results in a quick rise in temperature of the LED lamp. Generally, the LED lamp utilizes a heat sink to dissipate heat generated by the LEDs. A conventional LED lamp includes a rectangular heat dissipation plate and a number of LEDs mounted on a side of the heat dissipation plate. In operation, the heat generated by the LEDs can be quickly dissipated by the heat dissipation plate. However, the rectangular heat dissipation plate causes the LED lamp to be bulky and makes the LED lamp having an unattractive appearance.

What is needed, therefore, is an improved LED lamp which can overcome the above problems.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
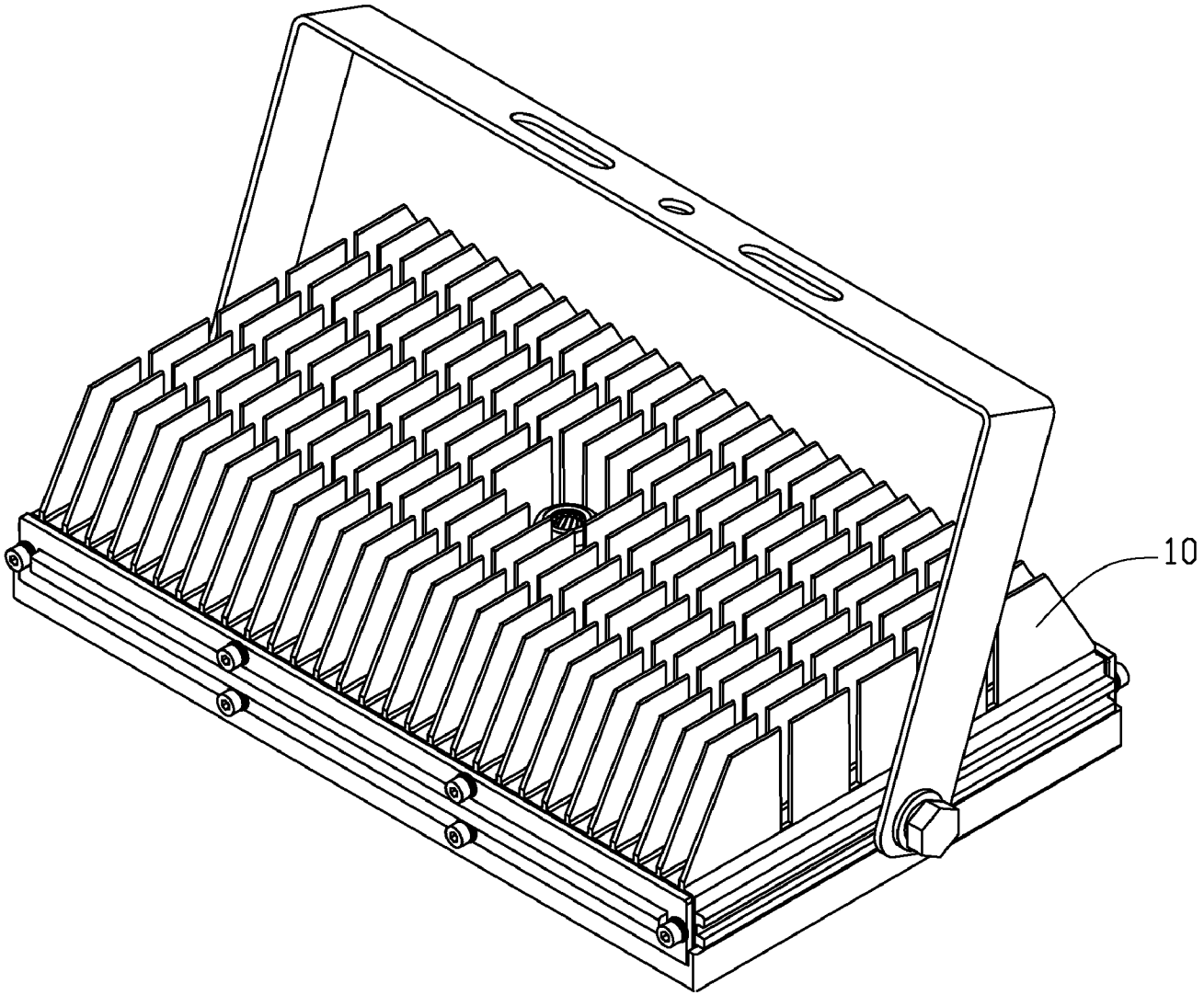
FIG. 1 is an isometric, assembled view of an LED lamp in accordance with an embodiment of the disclosure.
Figure 2:
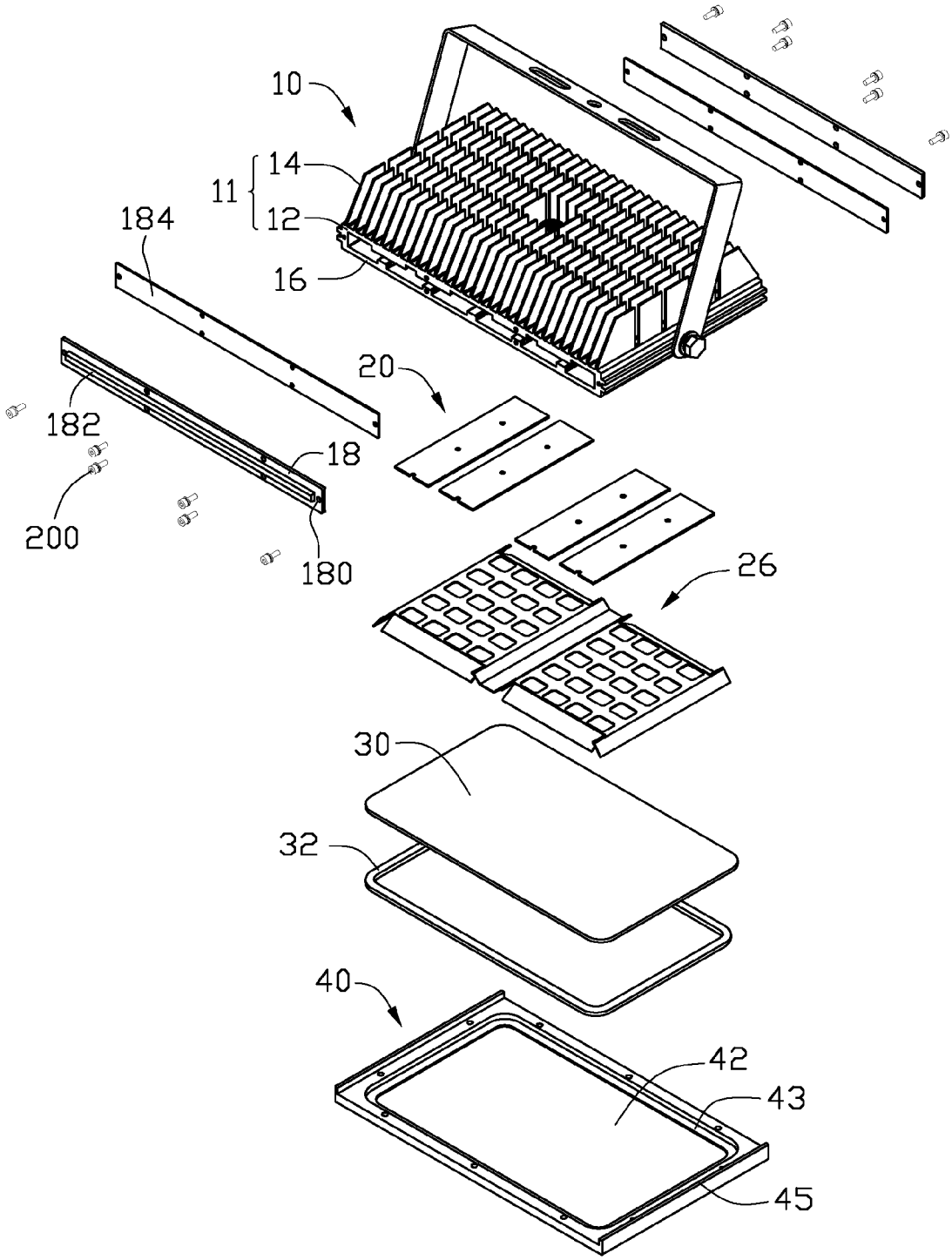
FIG. 2 is an exploded view of the LED lamp of FIG. 1.

Referring to FIGS. 1-2, an LED lamp in accordance with an embodiment of the disclosure is illustrated. The LED lamp comprises a housing 10, a plurality of LED modules 20 thermally received in the housing 10, a cover 30 covering the LED modules 20 and a pressing frame 40 securing the cover 30 to the housing 10.

Figure 3:
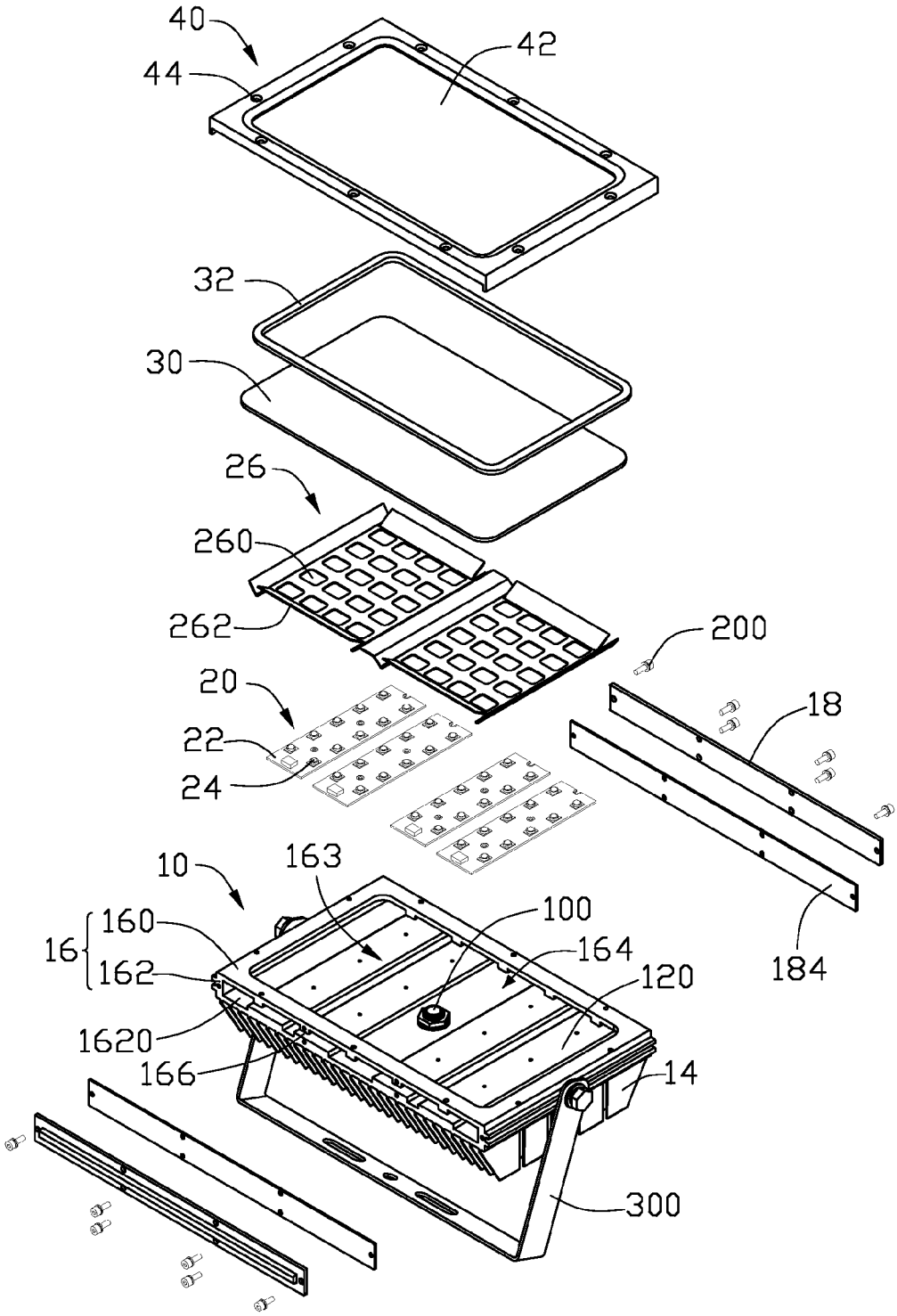
FIG. 3 is an inverted, exploded view of the LED lamp of FIG. 1.

Referring to FIG. 3 also, the housing 10 is integrally extruded from a metal with a good heat conductivity such as aluminum. The housing 10 comprises a heat sink 11 to which the LED modules 20 are attached and a hollow receiving portion 16 extending downwardly from a bottom of the heat sink 11. The heat sink 11 comprises a planar base 12, a plurality of fins 14 extending upwardly and perpendicularly from a top face of the base 12, and a plurality of rectangular heat-absorbing portions 120 protruding downwardly from a bottom face of the base 12. The heat-absorbing portions 120 are parallel to and spaced from each other. A plurality of threaded holes (not labeled) are horizontally defined in front and rear sides of some of the heat-absorbing portions 120, respectively. The fins 14 are spaced from each other. A passage is defined between every two adjacent fins 14 to allow airflow therethrough. The receiving portion 16 comprises an annular frame 160 in a rectangular shape and two sidewalls 162 extending upwardly and perpendicularly from left and right sides of the frame 160. The two sidewalls 162 interconnect left and right sides of the bottom face of the base 12 and the frame 160. The frame 160, the two sidewalls 162 and the bottom face of the base 12 cooperatively define a receiving chamber 164 for receiving the LED modules 20 therein. Front and rear sides of the receiving portion 16 define two elongated opening 1620, respectively. The frame 160 is parallel to and spaced from the base 12. The frame 160 defines a rectangular window 163 at a center thereof for light emitted by the LED modules 20 passing therethrough. A plurality of spaced blocks 166 protrude upwardly from a top face of the frame 160 towards the base 12. A plurality of screw holes (not labeled) are horizontally defined in some of the blocks 166, respectively. The housing 10 further comprises two lateral plates 18 fixed to the receiving portion 16 and correspondingly covering the two openings 1620 of the receiving portion 16, and two sealing boards 184 sandwiched between the two lateral plates 18 and the receiving portion 16, respectively. A plurality of fixing orifices 180 are equidistantly defined near a periphery of each of the lateral plates 18. Screws 200 extend through the fixing orifices 180 of the lateral plates 18, the sealing boards 184 and into the threaded holes in the heat-absorbing portions 120 and the screw holes in the blocks 16 of the housing 10, whereby the lateral plates 18 are secured to the housing 10. An elongated protruding rib 182 protrudes outwardly and horizontally from an outer face of each lateral plate 18, wherein the rib 182 extends along a lengthwise direction of the lateral plate 18. A through hole is defined at a center of the base 12 for receiving a waterproof connector 100 therein. The waterproof connector 100 can prevent water or dirt at a top of the housing 10 from entering the receiving chamber 164 to cause short circuit or contamination of the LED modules 20. A passage is defined in the waterproof connector 100 for extension of wires (not shown) therethrough to electrically connect the LED modules 20 with a power source.

The LED modules 20 are thermally mounted on bottom faces of the heat-absorbing portions 120 of the heat sink 11, respectively, whereby heat generated by the LED modules 20 is absorbed by the heat-absorbing portions 120, transferred by the base 12 and dissipated to ambient air through the fins 14. Each LED module 20 comprises an elongated printed circuit board 22 and a plurality of LEDs 24 evenly mounted on the printed circuit board 22. A light-guiding board 26 is further provided to the LED lamp and correspondingly disposed on the LED modules 20, for directing the light emitted by the LED modules 20 to have required illumination characteristics. The light-guiding board 26 defines a plurality of mounting holes 260 in which a plurality of lens (not shown) are fixed and accommodate the LEDs 24 of the LED modules 20 therein, respectively. A plurality of flanges 262 are bended inclinedly and upwardly from edges of the light-guiding board 26.

The cover 30 is rectangular and has a shape similar to that of the window 163 of the frame 160 of the housing 10. The cover 30 is made of transparent materials such as plastic, glass, or other suitable material availing to transmit light. An annular gasket 32 made of rubber is further provided to the cover 30 to encircle an outer periphery of the cover 30 for protecting the cover 30 and sealing the LED lamp.

The pressing frame 40 is rectangular and defines a rectangular hole 42 at a center thereof. A top face of the pressing fame 40 depresses downwardly to form an annular recess 43 surrounding the hole 42 for receiving the annular gasket 32 and an edge of the cover 30. Two lateral walls 45 extend upwardly and perpendicularly from left and right sides of the pressing fame 40, respectively. The two lateral walls 45 are attached to outer faces of the two sidewalls 162, respectively.

A supporting bracket 300 is further provided to the LED lamp for locating the LED lamp at a required position, for example to the ground whereby the LED lamp can function as a projection lamp, or to a ceiling whereby the LED lamp can function as a suspension lamp. The supporting bracket 300 is a bended metal sheet and comprises a straight section (not labeled) located above the housing 10 and two connecting sections (not labeled) bended perpendicularly downwardly from two opposite ends of the straight section. The two connecting sections are fixed to the two sidewalls 162 of the housing 10, respectively. Two screws (not labeled) extend through distal ends of the two connecting sections and into the two sidewalls 162, respectively. The supporting bracket 300 can pivot on the two screws relative to the housing 10.

In assembly, the LED modules 20 are placed in the receiving chamber 164 of the housing 10 and thermally attached to the heat-absorbing portions 120. The lateral plates 18 and the sealing boards 184 are securely fixed to the housing 10. The pressing frame 40 is coupled to the frame 160 of the housing 10 with the cover 30 sandwiched between the pressing frame 40 and the frame 160 and located correspondingly covering the LED modules 20. The light emitted by the LED modules 20 can radiate downwards through the transparent cover 30 to lighten a space outside the LED lamp.

Regarding the illustrated embodiment, the LED lamp has a compact structure with a receiving chamber 164 cooperatively formed among the frame 160, the two sidewalls 162 and the base 12, in which the LED modules 20 are received. A dimension and a weight of the LED lamp can be reduced, thereby facilitating a miniaturization of the LED lamp. Furthermore, since the whole housing 10 is made by extrusion, a total manufacturing cost of the LED lamp could be reduced in comparison with that made by die-casting in conventional lamps.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED lamp comprising:

a monolithic housing comprising a heat sink and a receiving portion integrally extending from a bottom of the heat sink, the heat sink comprising a planar base and a plurality of fins extending from a top face of the base, the receiving portion comprising a frame defining a window at a center thereof and two sidewalls interconnecting the frame and the base, and the frame, the sidewalls and the base cooperatively defining a receiving chamber;

a plurality of LED modules attached to the base of the housing and accommodated in the receiving chamber of the housing, and the LED modules located corresponding to the window of the frame, whereby light generated by the LED modules radiates through the window;

a cover mounted on a bottom of the frame and correspondingly covering the window; and a supporting bracket mounted on the housing.

2. The LED lamp of claim 1, wherein the frame is spaced from and parallel to the base.

3. The LED lamp of claim 2, wherein the base and the frame are both in rectangular shape.

4. The LED lamp of claim 3, wherein the two sidewalls interconnect left and right sides of the frame and the base, respectively.

5. The LED lamp of claim 4, wherein two openings are defined at front and rear sides of the receiving portion, respectively.

6. The LED lamp of claim 5 further comprising two lateral plates fixed to the receiving portion and correspondingly covering the two openings of the receiving portion, respectively.

7. The LED lamp of claim 6 further comprising two sealing boards sandwiched between the two lateral plates and the receiving portion, respectively.

8. The LED lamp of claim 1, wherein a plurality of elongated heat-absorbing portions protrude downwardly from a bottom face of the base and are spaced from each other, and the LED modules are thermally attached to the heat-absorbing portions, respectively.

9. The LED lamp of claim 1, wherein a plurality of spaced blocks protrude upwardly from a top face of the frame towards the base, and a screw hole is defined in one of the blocks.

10. The LED lamp of claim 1 further comprising a pressing frame securing the cover to the frame, the pressing frame defines a hole at a center thereof corresponding to the window of the frame.

11. The LED lamp of claim 10, wherein a top face of the pressing frame depresses downwardly to form an annular recess surrounding the hole for receiving an edge of the cover.

12. The LED lamp of claim 10, wherein two lateral walls extend upwardly from a left and right sides of the pressing fame, respectively, and the two lateral walls are attached to outer faces of the two sidewalls of the receiving portion of the housing, respectively.

13. The LED lamp of claim 1, wherein the supporting bracket comprises a straight section located above the housing and two connecting sections respectively bended from two opposite ends of the straight section, and the two connecting sections are fixed to the two sidewalls of the receiving portion of the housing, respectively.

14. The LED lamp of claim 13, wherein two screws extend through the two connecting sections and into the two sidewalls, respectively, and the supporting bracket is pivotable on the two screws relative to the housing.

15. The LED lamp of claim 1, wherein the heat sink defines a through hole communicating with the receiving chamber, and a waterproof connector is received in the through hole.

16. The LED lamp of claim 1, wherein the housing is made of metal extrusion.

17. The LED lamp of claim 1, wherein the housing is made of aluminum extrusion.

* * * * *